US005180294A

United States Patent [19]

Watchorn

[11] Patent Number: 5,180,294

[45] Date of Patent: Jan. 19, 1993

[54] CONCRETE PUMP HAVING PRESSURIZED SEAL FOR SWING TUBE

[75] Inventor: Ernest W. Watchorn, Vancouver, Canada

[73] Assignee: Confloat Consulting Ltd., Richmond, Canada

[21] Appl. No.: 846,222

[22] Filed: Mar. 4, 1992

[51] Int. Cl.[5] ..... F04B 7/00; F04B 15/02

[52] U.S. Cl. ..... 417/516; 417/517; 417/900

[58] Field of Search ..... 417/516, 517, 519, 900

[56] References Cited

U.S. PATENT DOCUMENTS

| | | | |
|---|---|---|---|
| 3,963,385 | 6/1976 | Caban | 417/517 |
| 3,982,857 | 9/1976 | Schlecht | 417/900 |
| 3,989,420 | 11/1976 | Taylor | 417/517 |
| 4,178,142 | 12/1979 | Schwing | 417/516 |
| 4,198,193 | 4/1980 | Westerlund et al. | 417/517 |
| 4,569,642 | 2/1986 | Dwyer | 417/516 |
| 4,614,482 | 9/1986 | Hudelmaier | 417/517 |

*Primary Examiner*—Richard A. Bertsch

*Assistant Examiner*—Alfred Basichas

*Attorney, Agent, or Firm*—Hughes & Multer

[57] ABSTRACT

A pressure sealing assembly for a swing tube-type concrete pump. The assembly provides a fluid-tight seal between the intake end of the swing tube and the ports of the pumping cylinders. Pressure faces are formed in the bearing assembly where the discharge end of the swing tube passes out of the concrete hopper, and a lubricating medium, such as grease, is positioned in this assembly adjacent the pressure face which is directed toward the intake end of the swing tube. Pressure is selectively supplied to the lubricating medium in the bearing assembly, so that this pressure applies the force toward the intake end of the swing tube, which forces the intake end of the swing tube into sealing abutment with a cylinder port. The grease pressure is supplied to the assembly by a hydraulic ram assembly, this receiving hydraulic pressure from the same source which operates the pumping cylinders of the pump, so that the application of pressure to the bearing assembly is timed in sequence with the pumping action of the cylinders.

26 Claims, 3 Drawing Sheets

CONCRETE PUMP HAVING PRESSURIZED SEAL FOR SWING TUBE

BACKGROUND OF THE INVENTION

1. Field of the Invention

The present invention relates generally to pumps for pumping concrete and like fluid mixtures, and, more particularly, to a pump of the type having a cranked delivery tube which swings in and out of register with a plurality of pumping cylinders, with longitudinal pressure being applied to the swing tube to effectuate a seal between it and the discharge ports of the pumping cylinders.

2. Background Art

In the laying of concrete, various automatic pumping systems have been suggested for moving the concrete from a transport truck mixer or other source to the deposit site. Among other factors, the relatively high viscosity and extreme abrasiveness of the concrete slurries play a central role in the design of these systems.

One system which has come into common use is the swing tube-type concrete pump. In systems of this kind, there is typically an open-topped hopper which receives the fluid concrete. A plurality of pumping cylinders (typically, two) are connected to the hopper so that their intake/discharge openings are in communication with the concrete in the hopper, usually near the bottom thereof. An S-shaped swing tube is mounted within the hopper so that it is pivotable about an axis provided by its discharge end, which is supported by a bearing in a wall of the hopper. The swing tube is connected to an external drive arm, which swings the tube back and forth so that its intake end moves into and out of register with the intake/discharge openings of the pumping cylinders. These cylinders operate 180° out of phase, so that one cylinder is drawing a charge of concrete from the hopper while the other is discharging its charge under pressure. The action of the swing arm is timed so that its intake opening is moved into register with the intake/discharge opening of each pumping cylinder as this discharges its charge of concrete, thus clearing the opening of the other cylinder so that this latter can draw its charge from the hopper.

While the merits of the swing tube-type concrete pump have rendered its use widespread within the industry, such machines have not been without their inefficiencies and difficulties in operation. For example, it is essential that a relatively fluid-tight joint be achieved where the intake opening of the swing tube mates with the intake/discharge ports of the pumping cylinders, in order to ensure that the proper concrete mix is delivered from the hopper to the delivery line and the deposit site. If there is any significant leakage here, this may cause the liquid (i.e., water) within the concrete to be forced from the pumped concrete back into the hopper, being that the pumping pressures are frequently very high. Such a loss of moisture changes the mix or slump of the concrete as delivered, and under severe leakage conditions, the moisture loss may be sufficient to result in a dry pack within the pumping line, which completely freezes and closes the pumping line. If this occurs, the system must be shut down so that the line can be cleared. This shutdown is relatively costly, not only in terms of the efforts needed to perform the maintenance on the pumping line, but also due to the delays in the construction activities which are supported by the machine.

Although attempts have been made to eliminate such leakage by essentially "preloading" the intake opening of the swing tube against the openings of the pumping cylinders, this has usually resulted in excessive wear of the mating surfaces of these parts, largely due to the extreme abrasiveness of the concrete mix.

A number of approaches have been suggested in the past with respect to overcoming these problems. For example, U.S. Pat. No. 4,198,193 (Westerlund et al.) shows an arrangement in which a sealing assembly is fitted around the intake end of the swing tube, this having an annular recess which receives a wear ring. A chamber behind the wear ring is filled with constant hydraulic pressure so as to force the wear ring into firm sliding engagement with a wear plate around the openings of the pumping cylinders. Of course, this continuous pressure between the ring and plate results in excessive wear of these components, and the patentees in this case simply provide that the wear ring is a disposable item to be replaced as needed, which necessitates undesirable maintenance and downtime in a field environment.

U.S. Pat. No. 3,963,385 (Caban) also shows another arrangement wherein a constant sealing pressure is maintained between the receiving end of the swing tube and the ports of the pumping cylinders. In this case, this is done by applying the sealing pressure at the bearing where the discharge end of the swing tube passes out of the hopper. A pressure ring (apparently threaded) is tightened against the sealed bearing which extends around the end of the swing tube, so as to force the other end of this against the cylinder ports. The patentee states that if additional pressure is desired, this can be supplied by also applying hydraulic force against the back side of the bearing.

Some systems have been proposed which exhibit a higher level of sophistication in that the application of pressure to sealingly engage the swing tube and the cylinder ports is timed so that this is relieved at the end of the discharge stroke of each cylinder, with the result that the intake end of the swing tube is then freed to move between the openings without being forced against them.

U.S. Pat. No. 4,569,642 (Dwyer) shows an arrangement of this type. A bracket around the receiving end of the swing tube extends out of the top of the hopper, with a hydraulic cylinder being mounted on the end of this to push against an outside wall of the hopper so that the force which is generated thereby is transmitted through the bracket to the end of the swing tube to achieve the sealing force; alternatively, the hydraulic ram is mounted to the end of the shaft of the pivot mounting of the swing tube so that the force is transmitted through this. In either case, the clamping action which is provided by the hydraulic ram is actuated when the intake end of the swing tube is positioned around one of the cylinder ports to receive a charge of concrete therefrom, and then is released so that the tube can be swung into register with the next cylinder. Whatever the effectiveness of this system, it represents a relatively cumbersome structural arrangement which necessitates the use of dedicated and expensive subassemblies.

U.S. Pat. No. 4,614,483 (Huldelmaier) shows another "timed" system for providing a seal between the pumping cylinders and the swing tube, this differing from the systems described above in that the seal is achieved by extending a sleeve out of the discharge port of the cylinder and into the mouth of the intake end of the swing tube, instead of by forcing the swing tube against the cylinder port. The sleeve member which is extended either by reaction of threaded portions of the member, or by the application of hydraulic pressure to annular chambers in front of and/or behind the sealing sleeve. The sleeve member is then withdrawn at the end of the discharge stroke of the cylinder so that the swing tube can be moved to the next port. Again, this would appear to be a relatively complicated and expensive arrangement, and one of doubtful reliability in the field.

U.S. Pat. No. 3,982,857 (Schlecht) shows a somewhat tidier arrangement in which the swing tube (which is downwardly extending in this case) is supported by a bearing in a transverse beam. In the lower end of this beam (i.e., toward the pumping cylinder ports), there is an annular hydraulic piston which abuts a shoulder around the exterior of the swing tube. An annular chamber is formed between the bearing body and the annular piston. When the inlet opening of the swing tube is positioned around a cylinder port, pressure is admitted to the cylinder space so that the piston, abutting against the shoulder, presses the intake opening of the tube against the wall around the port. Then, when the swing tube is to be moved to the other opening, the hydraulic pressure is relieved. A labyrinth assembly is mounted between the bin and the hydraulic piston so as to prevent contamination of the latter.

While the sealing assembly which is disclosed in the Schlecht patent may be generally simpler and neater in its construction than some of the other devices which have been described above, and also may be somewhat more efficient in applying a sealing force between the intake of the swing tube and the openings of the pumping cylinders, this device is nevertheless not without its drawbacks. For example, the arrangement requires the complexity of having separate piston and bearing assemblies, and the hydraulic piston assembly itself is relatively complex and must be manufactured to close tolerances. Apart from adding to the expense of manufacture, such complexity would also tend to reduce durability in operation. Furthermore, the arrangement requires the use of a dedicated hydraulic line for supplying pressure to the piston assembly.

Accordingly, there exists a need for a concrete pump of the swing tube-type which is provided with a simplified and effective system for pressing the intake end of the swing tube into engagement with receiving areas about the intake/discharge ports of the multiple pumping cylinders of the pump so as to achieve an effective fluid-tight seal therewith, and which releases such pressure after the completion of the discharge stroke so that the tube can be swung into register with the port of the next cylinder. Furthermore, the need exists for a pump having such a system which makes efficient use of existing structures which are required by the nature of the swing tube-type design, and which minimizes the need for dedicated and complex assemblies to achieve the desired sealing pressure. Still further, there exists a need for a pump having such a system which is both reliable in the field and durable over extended periods of use.

SUMMARY OF THE INVENTION

The present invention has solved the problems cited above, and comprises a pressure sealing apparatus for use in a concrete pump having a plurality of pumping cylinders which charge and discharge alternately, each of these having a port through which the concrete is discharged, and a pivotally mounted swing tube having an intake end which moves into and out of register with each port alternately so as to receive the concrete which is discharged therefrom. Broadly, the pressure sealing apparatus comprises a bearing assembly for pivotally supporting a discharge end of the swing tube, this comprising a first bearing portion which is mounted to a support structure and a second bearing portion which is mounted to the swing tube, the second bearing portion having a pressure face formed thereon to receive a force which is directed toward the intake end of the swing tube. A lubricating medium is positioned in the bearing assembly adjacent the pressure face; means are provided for selectively supplying pressure to this lubricating medium, so that the pressure applies the force toward the intake end of the swing tube to the pressure face, and this force is transmitted from the pressure face to the swing tube so that the intake end thereof is forced into fluid-tight sealing abutment with a cylinder port which is in register with the intake end of the tube.

Preferably, the means for supplying pressure to the lubricating medium in the bearing is configured to supply this pressure when the intake end of the swing tube is in register with the port of the cylinder which is discharging concrete, and to then relieve this pressure when the cylinder terminates discharging the concrete, so that the intake end of the tube is freed from its sealing abutment with the port in order to be freely pivoted into register with the next port.

The first bearing member may comprise a sleeve member which receives the discharge end of the swing tube, with this sleeve member having an inwardly projecting shoulder portion which forms a first bearing surface with the exterior of the swing tube, and the second bearing member being an outwardly projecting shoulder portion on the swing tube which forms a second bearing surface with the interior of the sleeve member. The inwardly and outwardly extending shoulder portions are spaced apart longitudinally to form the pressure chamber intermediate these portions. The lubricating medium may be a relatively viscous grease for lubricating these bearing surfaces.

The means for supplying pressure to the lubricating medium may comprise a hydraulic ram assembly for selectively applying pressure to a reservoir containing a supply of the lubricating medium, with means being provided for connecting this reservoir in fluid communication with the pressure chamber in the bearing assembly. Preferably, the hydraulic ram assembly is configured to apply pressure to the reservoir when the intake end of the swing tube is in register with a port of a selected cylinder which is discharging concrete, and to then relieve this pressure when the selected cylinder terminates discharging the concrete, so that the intake end of the tube is freed from the sealing abutment with the cylinder port in order to be freely pivoted into register with the next port.

A concrete pump is also provided, this comprising a plurality of pumping cylinders which charge and discharge alternately, each of these having a port through which the fluid concrete is discharged. There is a pivotally mounted swing tube having an intake end which moves into and out of register with each of these ports alternately so as to receive the concrete which is discharged therefrom, and a bearing assembly is provided for pivotally supporting the discharge end of the swing tube in a support structure, this comprising a first bearing portion which is mounted to the support structure and a second bearing portion which is mounted to the swing tube. The second bearing portion has a pressure face formed thereon to receive a force which is directed toward the intake end of the swing tube. Lubricating medium is positioned in the bearing assembly adjacent the pressure face, and means are provided for selectively supplying pressure to this lubricating medium so that the pressure applies a force toward the intake end of the swing tube to the pressure face, with this force being transmitted from the pressure face to the swing tube so that the intake end is forced into sealing abutment with the cylinder port which is in register therewith.

The pump may further comprise a hopper for holding a supply of the fluid concrete, with the ports of the pumping cylinders being formed in a first wall of this so as to be in communication with the supply of concrete. The swing tube may be positioned within the hopper, and the support structure to which the sleeve member of the bearing assembly is mounted may comprise a second wall of the hopper through which the discharge end of the swing tube passes opposite the first wall.

Other features, and a fuller appreciation of the structure and utility of the present invention, will be gained upon an examination of the detailed description of the invention, taken in conjunction with the accompanying figures.

DETAILED DESCRIPTION

Pump Assembly Overview

The present invention relates to a swing tube-type concrete pump having an improved apparatus for achieving a fluid-tight seal between the intake end of the swing tube and the ports of the plurality of pumping cylinders of the pump. Accordingly, an overview of the concrete pump assembly will be provided here with reference to FIG. 1, with the specific description of the sealing apparatus to follow.

Figure 1:
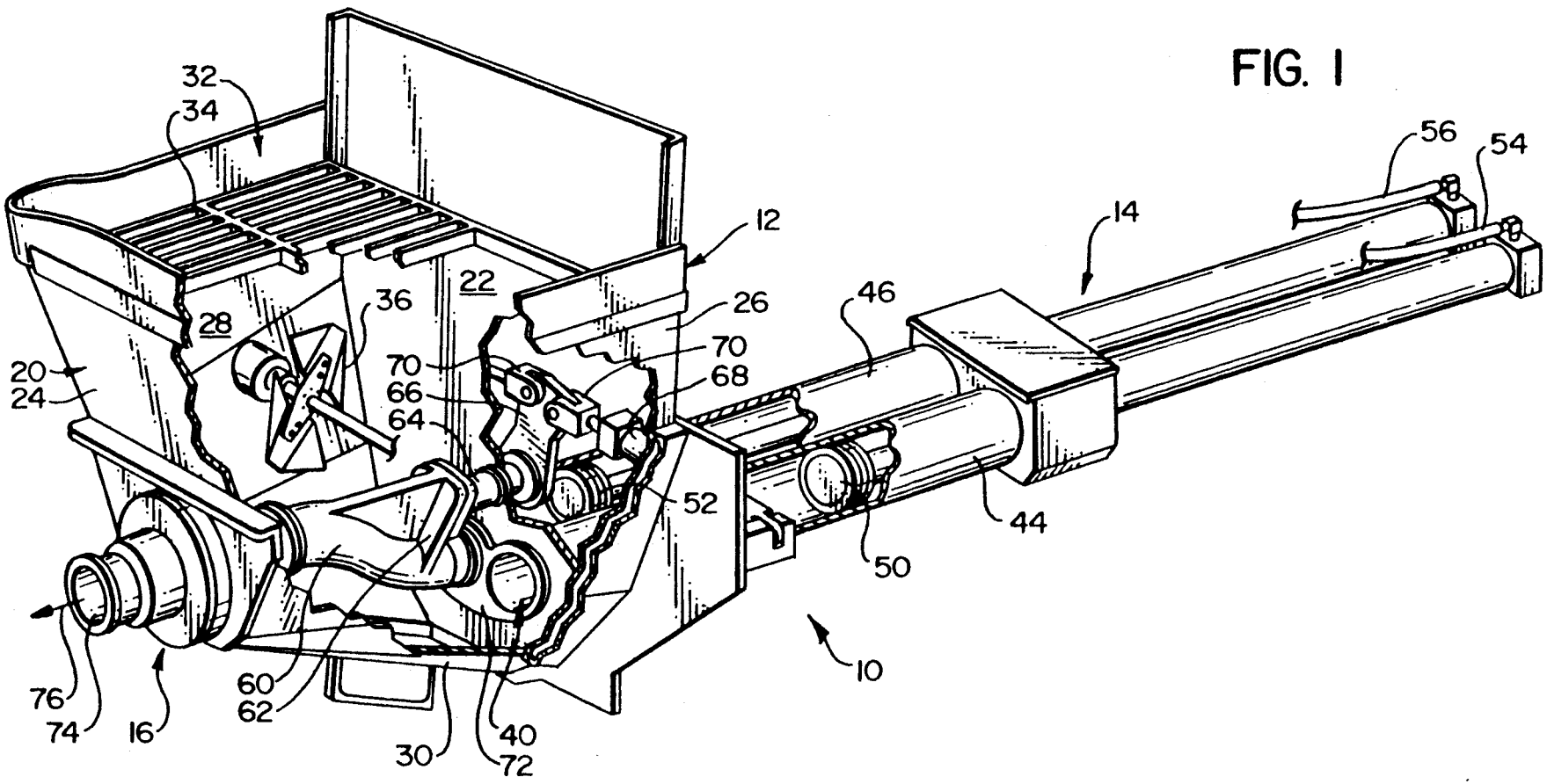
FIG. 1 is a perspective view, with parts broken away, of a swing tube-type cement pump incorporating the sealing apparatus of the present invention.

FIG. 1 shows concrete pump assembly 10, this comprising generally a hopper assembly 12, a pump cylinder assembly 14, and a swing tube and discharge assembly 16. Pump assembly 10 is typically employed to pump fluid concrete to various locations at a construction site, although it may also be employed to pump cement slurry and other suitable fluid mixtures in various applications.

Hopper assembly 12 comprises a bin-like hopper 20 made up of rearward and forward walls 22 and 24, side walls 26 and 28, and a closed bottom portion 30. The concrete is received into the hopper through its open top portion 32 (from a delivery truck or other source), with a grate 34 being installed therein to screen out excessively large objects. A bladed agitator assembly 36 is positioned within the hopper so as to keep the concrete well mixed, and to prevent it from setting up.

In the rearward wall 22 of the hopper assembly, near the closed bottom portion thereof, there are first and second intake/discharge ports for the pump cylinder assembly. This comprises first and second pump cylinders 44 and 46, each of which encloses a double-ended piston 50, 52. These are operated by hydraulic pressure supplied from a suitable source (not shown) through pressure supply lines 54, 56. As previously noted, these pistons 50, 52 operate 180° out of phase with each other, so that as the first piston is discharging concrete from its cylinder, the other is retracting into the cylinder so as to draw in a charge of the concrete. For example, in FIG. 1 the one piston 52 is shown in the process of discharging the concrete from its associated cylinder, while the other piston 50 is drawing the concrete into its cylinder through port 40.

As was also noted above, the discharge from the cylinders of the cylinder assembly is directed into and discharged through the swing tube assembly 16. This comprises the swing tube 60 itself, which is generally S-shaped, this having a forward portion which discharges through, and is supported for rotation in, the forward wall of the hopper. The rearward, intake end of the swing tube bends downwardly from the forward end so that this is aligned with the intake/discharge ports of the pump cylinders, and a support bracket 62 extends upwardly from this and is attached to a torque tube 64 which passes through, and is supported for rotation in, the rearward wall 22 of the hopper assembly. A crank arm 66 is mounted to the outer end of torque tube 64, and this is driven back and forth by first and second hydraulic rams 68 (one only shown in FIG. 1) which are attached to the end of the crank arm by clevices 70. Thus, as hydraulic rams 68 work crank arm 66 back and forth, this causes the swing tube to rotate about the axis provided by torque tube 64 and the forward end of the swing tube, moving the intake end of the swing tube in and out of register with the ports 40, 42 of the pump cylinders. As this is done, the intake end of the swing tube slides along a spectacle plate 72 which extends around the two ports, as will be described below.

The concrete which is forced into swing tube 60 from the pump cylinders 44, 46 travels therethrough, and exits from the pump assembly through a discharge outlet 74, generally in the direction indicated by arrow 76. Typically, this discharge outlet 74 is connected to the inlet end of a hose, through which the concrete is led to the desired placement site. As this is done, the high pressures which are generated by the pistons in discharging the concrete from the cylinders tends to force the intake end of the swing tube away from its seat against the spectacle plate, which would otherwise tend to cause leaks around the discharge ports from the cylinders; the machine 10 incorporating the present invention is provided with a pressure sealing assembly 80 which serves to eliminate such leaks, without causing excess wear in the system.

Pressure Seal Assembly

Figure 2:
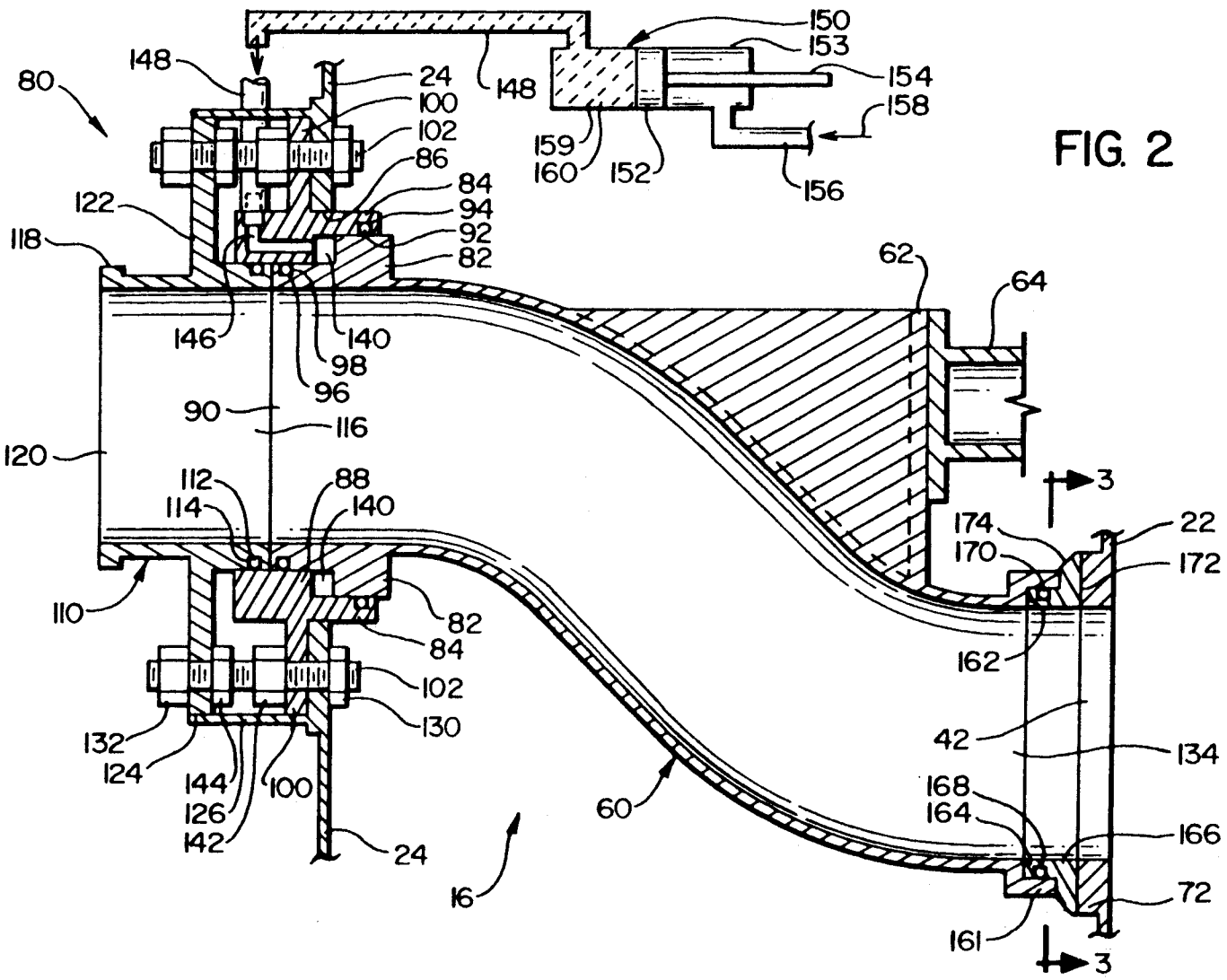
FIG. 2 is a sectional, side elevational view of the swing tube portion of the cement pump of FIG. 1, showing sealing apparatus in accordance with the present invention mounted about the discharge end of the swing tube, with a portion of this system being shown in schematic.

FIG. 2 shows a section taken longitudinally through swing tube 60 and the pressure seal assembly 80 which is associated with its discharge end. As was previously noted, the discharge end of the swing tube is supported for rotation in the forward wall 24 of the hopper. This discharge end of the rotatable tube is provided with a radially extending shoulder portion 82, and this is received in a sleeve member 84 which is fixedly mounted in a circular opening 86 in wall 24 of the hopper. The shoulder 82 on the swing tube fits closely within the relatively large-diameter rearward opening into the sleeve member, and is spaced rearwardly from the actual discharge end of the swing tube, which is relatively smaller in diameter. Conversely, the bore through the sleeve member 84 narrows towards its forward end, so that there is an inwardly extending shoulder 88 which fits closely around the actual discharge end 90 of the swing tube.

A first elastomeric sealing ring (e.g., an "O" ring seal) 92 is received in an annular groove 94 about the mouth portion of sleeve member 84, so that this sealingly yet rotatingly engages the shoulder 82 on the swing tube, while a second seal ring 96 is received in an annular groove 98 which is formed about the exterior of the smaller diameter discharge end 90 of the tube, so that this similarly engages the inwardly projecting shoulder 88 of sleeve member 84. This discharge end of the swing tube is thus free to rotate relative to the sleeve member, and the sleeve member is provided with a radially extending flange portion 100 which is secured against rotation by bolts 102, which pass through cooperating bores in the flange 100 and the wall 24 of the hopper assembly.

The circular opening at the discharge end 90 of swing tube 60 forms a bearing surface which flushly abuts a corresponding bearing surface formed by the circular intake opening of discharge fitting 110. Another seal ring 112 is received in an annular groove 114 about the exterior of the intake end 116 of the discharge fitting, so that this sealingly engages the inner surface of the shoulder 88 on sleeve member 84. It will be appreciated that these seal rings 112, 96, and 92 permit a degree of both rotational and longitudinal movement of their associated members relative to the members which they abut.

Discharge fitting 110 is generally cylindrical in shape, and has a slight shoulder 118 or other attachment fitting formed about its discharge end 120 for connection to a hose or like conduit for the concrete. A relatively large mounting flange 122 extends radially from a middle portion of the discharge fitting, and this has cooperating bores which receive outer ends of the bolts 102 so that discharge fitting 110 is held against rotation. The outer edge 124 of the mounting flange fits within a cylindrical collar 126 which abuts and extends forwardly from the wall 24 of the hopper, so as to provide additional support to the structure against lateral forces, and so as to prevent the accumulation of cement and dirt around the shanks of the bolts, hydraulic fittings, and so forth which are enclosed therein.

As noted above, bolts 102 pass through cooperating bores in (a) the mounting flange of the discharge fitting 110, (b) the mounting flange of the sleeve member 84, and finally (c) the wall 24 of the hopper. To assemble these components, the bolts are passed through the cooperating bores in the three members, and then outer cinch nuts 130, 132 are tightened together to move mounting flange 122 of discharge fitting 110 toward the wall of the hopper. This, in turn pushes swing tube 60 rearwardly so that its intake end 134 is moved into close proximity with the spectacle plate 72 on the rearward wall of the hopper. As this is done, the outwardly extending shoulder 82 on the discharge end of the swing tube moves rearwardly away from the inwardly projecting shoulder 88 on the sleeve member 84, being that this latter is held against rearward motion by the abutment of its mounting flange against the outside of the wall of the hopper. As a result of this separating movement, an annular chamber 140 is formed intermediate shoulders 82 and 88. When the desired proximity of the intake end of the swing tube to the spectacle plate has been achieved (and, due to the configuration of the shoulders, the desired size of chamber 140 has been formed), lock nuts 142, 144 are tightened against the sides of their respective flange members opposite the cinch nuts so as to retain the associated components in this position. Collar 126 is then slipped over the outer edges of flanges 122 and 100 so as to be in frictional engagement with these.

It will thus be seen that this arrangement provides a bearing assembly which supports and permits the rotation of the discharge end of the swing tube relative to the stationary sleeve member and discharge fitting. The shoulder 82 on the end of the swing tube in essence forms a bearing surface with the mouth of the sleeve member, and the forward face of this shoulder forms a pressure face towards the mating (i.e., intake) end of the swing tube. The shoulder 88 on the sleeve member, in turn, forms a bearing surface with the end of the swing tube, and its rearward face forms a fixed pressure face in opposition to that on shoulder 88, these being spaced apart to form the annular pressure chamber 140.

Fluid communication between annular chamber 140 and a pressure supply line 148 is provided by an internal passage 146 through sleeve member 84. The supply line interconnects the chamber with a hydraulic ram assembly 150, this having a piston member 152 which is positioned within a cylinder member 153 and supported for movement therein by a piston rod 154. Pressure is applied to the back side of piston member 152 through a hydraulic pressure supply line 156, this being connected to a source of hydraulic pressure which enters the supply line in the direction indicated by arrow 158. As this is done, piston member 152 applies the pressure to a reservoir portion 158 of the ram assembly, this being filled with a suitable lubricating fluid; this fluid is preferable grease 160 which, while still being relatively viscous in the manner of greases, is sufficiently fluid to be forced through supply line 148 and internal passage 146 into annular chamber 140. As the pressurized grease is received in this area, it reacts against the pressure faces provided by fixed shoulder 88 and longitudinally movable shoulder 82 so as to force these apart, which moves shoulder 82 (and the swing tube to which it is mounted) towards the rearward wall of the hopper assembly.

The application of the hydraulic pressure to ram assembly 150 is timed sequentially with the movement of the swing tube so that the pressure is selectively applied when the intake end 134 of the swing tube is positioned around one or the other of the pump cylinder ports to receive a charge of concrete therefrom. When the discharge stroke of that cylinder has been completed, the pressure to ram assembly 150 is relieved so that swing tube 60 is released from the force against the rearward wall of the hopper, and can therefore be swung freely to the next cylinder port, where the pressurization and release steps are repeated. As was noted above, the supply line for hydraulic ram 150 is preferably connected to the same hydraulic source as operates the pump cylinder assembly 14; accordingly, the application of pressure to chamber 140 can be timed simply by applying hydraulic pressure to ram assembly 150 in the same sequence as is done with the main pumping cylinders. In other words, when intake opening of the swing tube has been positioned around the port of a first cylinder assembly, positive pressure is applied to this cylinder assembly to drive the piston (50 or 52) through the discharge stroke; simultaneously this positive pressure is applied to the back side of the piston 52 in ram assembly 150 to pressurize chamber 140 and force the intake opening of the swing tube into sealing abutment with the cylinder port. Then, when the discharge stroke of the main pumping cylinder has been completed, the supply of positive pressure to that cylinder is terminated; simultaneously, this reduction of pressure is applied to hydraulic ram 150 so as to remove at least a major portion of the pressure from chamber 140, releasing rearward pressure on the swing tube. In this regard, it should be noted that hydraulic ram 150 is preferably sized so that when the supply of pressure thereto is released, this will tend to relieve the pressure in chamber 140, but will not produce a pressure in the grease less than that of the concrete in the swing tube so as to tend to draw foreign matter into this area from the outside.

The piston rod 154 is mounted to the back (hydraulic) side of piston 152, and this is sized so that the pressure on the grease reservoir is relatively lower than the hydraulic pressure which is acting thereon, but still somewhat higher than that of the concrete which is pumped through the swing tube. The area of the pressure face on the shoulder 82 on which the grease pressure acts, in turn, determines the force with which the face of the intake end of the swing tube is pressed against the spectacle plate around the cylinder port; since the grease pressure exceeds that of the pumped concrete, the area formed on shoulder 82 on which the grease pressure acts need not be as great as the abutment area on the spectacle plate in order to achieve a relatively fluid-tight seal, thus facilitating the use of a compact bearing/pressure seal assembly 80. Thus, it will be understood that the hydraulic pressure, the grease pressure, and the concrete pressure are all interrelated, with the grease pressure being less than the hydraulic pressure but greater than the concrete pressure, with the respective piston members being sized to develop these relative pressures from the hydraulic pressure which is inputted into the system.

The end of piston rod 154 extends outwardly from the housing of hydraulic ram assembly 150 so as to be visible to an operator, and this provides a visual indication of the amount of grease which is left in the reservoir. This permits the operator to determine when this needs to be replenished, and to also determine whether there is excessive leakage of the grease. In order to facilitate this determination, the end of rod 154 may be provided with a series of graduations or other markings, as shown in FIG. 2, which can be read as the rod recedes into the housing.

The pressure seal assembly 81 having the foregoing construction is provided with manifold advantages over previously known systems. Firstly, by applying the pressure at the rotary seal itself, rather than in a separate hydraulic piston arrangement such as is done in the Schlecht patent, the assembly is greatly simplified and is much more reliable; in essence, the present invention takes the bearing portion of the pump assembly, which is already necessary due to the swing-tube action of the pump, and employs this same portion of the structure to serve the secondary purpose of achieving a fluid-tight seal between the swing tube and the cylinder ports. As a result, not only is the need for a separate hydraulic piston assembly dispensed with, but the need for associated structures such as the protective labyrinth assembly of the Schlecht device are similarly eliminated. Furthermore, the use of grease as the pressurizing fluid, with its relatively high viscosity, reduces the criticality of providing close tolerances between the end of the swing tube and the sleeve member, thus reducing their initial manufacturing costs and increasing their useful service life; also, the simple arrangement of the sealing rings in their annular grooves is much easier and cheaper to manufacture than a corresponding hydraulic cylinder, with the close tolerance and special seals which are required by the low viscosity of the hydraulic fluid. Still further, the grease which is applied under pressure to chamber 140 will naturally migrate into the bearing spaces between sleeve member 84 and the ends of the swing tube and discharge fitting which are received therein, thus providing the function of lubricating these areas while also applying the clamping pressure to the swing tube, without requiring separate, dedicated systems and fittings for accomplishing these two functions. Also, (relating again to the non-criticality of the clearances between these part) it is not necessarily undesirable that a small amount of this grease escape between the sleeve member and the shoulder on the swing tube, inasmuch as this serves to maintain a fresh supply of grease between these two working members, and also flushes contaminant materials out of this area. Furthermore, the extent of any such leakage is limited to the relatively small amount of grease which is contained in the reservoir within the arm assembly. This is to be contrasted with the situation which would exist if a hydraulic piston arrangement were to be employed, as is done in the Schlect device, where any failure of the seal would result in significant, uncontrolled loss of the hydraulic fluid, draining the hydraulic system and possibly contaminating the concrete.

Intake End Assembly

The foregoing description has centered on the pressure seal assembly which clamps the intake end of the swing tube about the intake/discharge ports of the pump cylinders. As is shown in FIG. 2, this end of the swing tube assembly is provided with a radially extending shoulder portion 160 which has an annular recess 162 cut into its interior surface. This is configured to receive a longitudinally extending sleeve portion 164 of a wear ring 166 so that this fits closely within recess 162. The interior bores of the wear ring and the swing tube are matched so as to provide a smooth, unimpeded flow of the concrete therethrough. An annular groove 168 is formed in the exterior of the sleeve portion of the wear ring, and a sealing ring 170 is positioned in this so as to form a seal for preventing the escape of the fluid from the concrete between the wear ring and the shoulder portion 160 of the swing tube. The mating surface 172 of the wear ring, in turn, slidingly abuts the spectacle plate 72 which is mounted to the rearward wall 22 of the hopper, about the intake/discharge ports 40, 42 of the pumping cylinders.

The foregoing arrangement in which the wear ring 166 is slidingly received in the end of the swing tube facilitates the simple and rapid change-out of this part when it eventually becomes worn, although this eventuality is greatly delayed due to the fact that the pressure on this is relieved when the tube is pivoted from one port to the other. Also, it should be noted that the length of the sleeve portion of the wear ring is preferably greater than the longitudinal extant of the pressure chamber 140 which is formed between the shoulders on the discharge end of the swing tube and the sleeve portion of the assembly, so as to eliminate any possibility of the wear ring becoming dislodged in the event that the pressure chamber is completely retracted.

Figure 3:
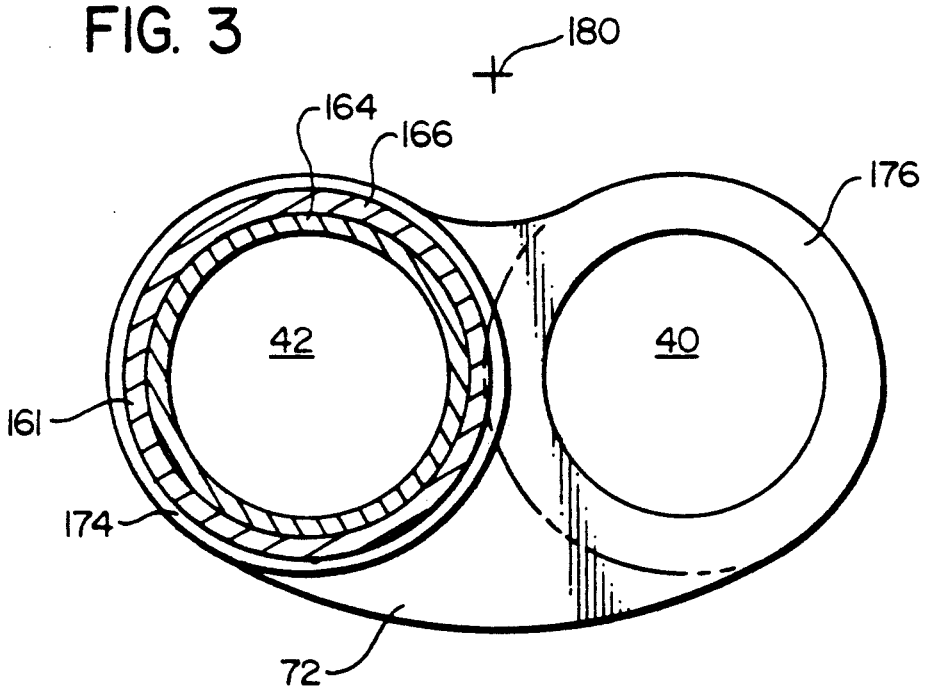
FIG. 3 is a sectional, end elevational view taken along line 3—3 in FIG. 2, showing the intake/discharge ports of the two pumping cylinders of the concrete pump together with their surrounding spectacle plate, and the manner in which the intake end of the swing tube is positioned around these ports.

FIG. 3 is an end view of the spectacle plate 72, and more clearly shows the relationship between this and the intake end 134 of the swing tube. As can be seen, the spectacle plate 72 is generally kidney shaped, and provides a circular mating surface 176 about each of the intake/discharge ports 40, 42. The radial width of these mating surfaces (as indicated by the dotted line shown in FIG. 3) preferably corresponds generally to the radial width of the mating ring 172 on wear ring 166, although this may vary somewhat. The remainder of the spectacle plate provides a smooth, continuous surface or web between the two ports, over which the wear ring can freely slide when the sealing pressure thereon is released, as the swing tube is pivoted back and forth about the axis which is indicated at 180. Preferably, spectacle plate 72 is constructed of a somewhat harder wearing material than wear ring 166, since the latter is cheaper and easier to replace.

FIG. 3 also illustrates the concentric relationship of the inner sleeve portion 164 of the wear ring within the recess in the shoulder portion 160 on the intake end of the swing tube, and the flange portion 174 of the wear ring which extends radially beyond shoulder 160.

While the invention has now been described with reference to these preferred embodiments, those skilled in the art will appreciate that various substitutions, changes, modifications, and omissions may be made without departing from the spirit thereof. Accordingly, it is intended that the scope of the present invention be limited solely by that of the claims which are granted herein.

What is claimed is:

1. In a concrete pump having a plurality of pumping cylinders which charge and discharge alternately, each said cylinder having a port through which fluid concrete is discharged, and a pivotally mounted swing tube having an intake end which moves into and out of register with each said port alternately so as to receive said concrete which is discharged therefrom, a pressure sealing apparatus for providing a fluid-tight seal between said intake end of said swing tube and said ports with which said intake end is in register, said pressure sealing apparatus comprising:

a bearing assembly for pivotally supporting a discharge end of said swing tube, said bearing assembly comprising a first bearing portion mounted to a support structure and a second bearing portion mounted to said swing tube, said second bearing portion having a pressure face formed thereon to receive a force directed toward said intake end of said swing tube;

a lubricating medium positioned in said bearing assembly adjacent said pressure face on said second bearing portion; and means for selectively supplying pressure to said lubricating medium in said bearing assembly so that said pressure applies said force toward said intake end of said swing tube to said pressure face thereon, and said force is transmitted from said pressure face to said swing tube so that said intake end of said tube is forced into sealing abutment with a said port with which said intake end of said tube is in register.

2. The pressure sealing apparatus of claim 1, wherein said means for supplying pressure to said lubricating medium in said bearing is configured to supply said pressure when said intake end of said swing tube is in register with a said part of a selected cylinder which is then discharging said concrete, and to then relieve said pressure when said selected cylinder terminates discharging said concrete, so that said intake end of said tube is freed from said sealing abutment with said port of said selected cylinder in order to be freely pivoted into register with a said port of another said cylinder.

3. The pressure sealing apparatus of claim 1, wherein said first bearing member comprises a sleeve member which is configured to receive said discharge end of said swing tube.

4. The pressure sealing apparatus of claim 3, wherein said first bearing member further comprises an inwardly projecting shoulder portion of said sleeve member which forms a first bearing surface with the exterior of said swing tube, and said second bearing member comprises an outwardly projecting shoulder portion of said swing tube which forms a second bearing surface with the interior of said sleeve member, said inwardly and outwardly extending shoulder portions being spaced apart longitudinally to form a pressure chamber intermediate said shoulder portions in which said lubricating medium is positioned.

5. The pressure sealing apparatus of claim 4, wherein said lubricating medium is a relatively viscous grease for lubricating said first and second bearing surfaces.

6. The pressure sealing apparatus of claim 5, wherein said pressure face comprises an outwardly extending face on said shoulder portion on said swing tube.

7. The pressure sealing apparatus of claim 4, wherein said first and second bearing surfaces each further comprises a sealing member for permitting both rotational and longitudinal movement of said swing tube relative to said sleeve member, so that said intake end of said swing tube is free to pivot into and out of register with said ports, and so that said swing tube is free to move longitudinally toward said ports in response to said force being applied to said pressure face.

8. The pressure sealing apparatus of claim 7, wherein said seal members are "O"-ring seals.

9. The pressure sealing apparatus of claim 7, wherein said means for supplying pressure to said lubricating medium comprises:

a hydraulic ram assembly for selectively applying pressure to a reservoir containing a supply of said lubricating medium; and means for connecting said reservoir in fluid communication with said pressure chamber in said bearing assembly.

10. The pressure sealing apparatus of claim 9, wherein said hydraulic ram assembly is configured to apply said pressure to said reservoir when said intake end of said swing tube is in register with a said port of a selected said cylinder which is then discharging said concrete, and to then relieve said pressure when said selected cylinder terminates discharging said concrete, so that said intake end of said tube is freed from said sealing abutment with said port of said selected cylinder in order to be freely pivoted into register with a said port of another said cylinder.

11. The pressure sealing apparatus of claim 10, wherein said pumping cylinders are operated by a source of hydraulic pressure, and said hydraulic ram assembly is operatively interconnected with said source of hydraulic pressure so that said hydraulic ram applies said pressure to said reservoir in repsonse to hydraulic pressure being supplied to said selected pumping cylinder to discharge said concrete through said port which is in register with said intake end of swing tube, and so that said hydraulic ram relieves said pressure on said reservoir in response to supply of hydraulic pressure to said selected pumping cylinder being terminated.

12. The pressure sealing apparatus of claim 4, further comprising a discharge fitting, said discharge fitting comprising:

an outlet end which is configured for attachment to a discharge line; and an inlet end which is received in said sleeve member opposite said discharge end of said swing tube, so that said inwardly projecting shoulder portion of said sleeve member fits sealingly about said inlet end of said discharge fitting, and so that said concrete flows from said swing tube into said discharge fitting through said sleeve member.

13. The pressure sealing apparatus of claim 12, wherein said intake end of said discharge fitting abuts said discharge end of said swing tube, and said discharge fitting further comprises adjustable means for applying a force to said discharge fitting toward said discharge end of said swing tube which is in abutment with said discharge fitting, so as to displace said swing tube outwardly from said sleeve member so that said intake end of said swing tube moves into a position proximate said ports of said cylinders, and said shoulder portion on said swing tube moves outwardly from said shoulder on said sleeve member so as to form said pressure chamber which is intermediate said shoulder portions.

14. The pressure sealing apparatus of claim 13, wherein said adjustable means for applying said force to said discharge fitting comprises:

a flange portion mounted to said discharge fitting;

at least one bolt having a first end mounted to said sleeve member which is mounted to said support structure, and a second end which passes through said flange portion of said discharge fitting; and an adjustable nut mounted on said second end of said bolt opposite said sleeve member, so that said force is applied to said discharge end of said swing tube in response to said adjustable nut being tightened on said bolt against said flange portion of said discharge fitting.

15. The pressure sealing apparatus of claim 13, further comprising a wear ring mounted to said intake end of said swing tube, said wear ring having a seating surface about an intake end of said ring and a sleeve portion about a discharge end of said ring, said sleeve portion of said ring being received in an annular recess in said intake end of said swing tube so as to permit a limited amount of longitudinal movement of said wear ring therein as said swing tube is displaced out of said sleeve member.

16. The pressure sealing apparatus of claim 15, wherein said wear ring further comprises sealing means for preventing escape of liquid from said concrete between said sleeve portion of said wear ring and said intake end of said swing tube.

17. The pressure sealing apparatus of claim 16, wherein said sealing means comprises an O-ring seal positioned about said sleeve portion of said wear ring within said annular recess in said intake end of said swing tube.

18. A concrete pump, comprising:

a plurality of pumping cylinders which charge and discharge alternately, each said cylinder having a port through which fluid concrete is discharged;

a pivotally mounted swing tube having an intake end which moves into and out of register with each said port alternately so as to receive said concrete which is discharged therefrom;

a bearing assembly for pivotally supporting a discharge end of said swing tube in a support structure, said bearing assembly comprising a first bearing portion mounted to said support structure and a second bearing portion mounted to said swing tube, said second bearing portion having a pressure face formed thereon to receive a force directed toward said intake end of said swing tube;

a lubricating medium positioned in said bearing assembly adjacent said pressure face on said second bearing portion; and means for selectively supplying pressure to said lubricating medium in said bearing assembly so that said pressure applies said force toward said intake end of said swing tube to said pressure face thereon, and said force is transmitted from said pressure face to said swing tube so that said intake end of said tube is forced into sealing abutment with a said part with which said intake end of said tube is in register.

19. The pump of claim 18, wherein said means for supplying pressure to said lubricating medium in said bearing is configured to supply said pressure when said intake end of said swing tube is in register with a said part of a selected cylinder which is then discharging said concrete, and to then relieve said pressure when said selected cylinder terminates discharging said concrete, so that said intake end of said tube is freed from said sealing abutment with said port of said selected cylinder in order to be freely pivoted into register with a said port of another said cylinder.

20. The pump of claim 18, wherein said first bearing member comprises a sleeve member which is configured to receive said discharge end of said swing tube.

21. The pump of claim 20, wherein said first bearing member further comprises an inwardly projecting shoulder portion of said sleeve member which forms a first bearing surface with the exterior of said swing tube, and said second bearing member comprises an outwardly projecting shoulder portion of said swing tube which forms a second bearing surface with the interior of said sleeve member, said inwardly and outwardly extending shoulder portions being spaced apart longitudinally to form a pressure chamber intermediate said shoulder portions in which said lubricating medium is positioned.

22. The pump of claim 21, wherein said pressure face comprises an outwardly extending face on said shoulder portion on said swing tube.

23. The pump of claim 21, wherein said first and second bearing surfaces each further comprises a sealing member for permitting both rotational and longitudinal movement of said swing tube relative to said sleeve member, so that said intake end of said swing tube is free to pivot into and out of register with said ports, and so that said swing tube is free to move longitudinally toward said ports in response to said force being applied to said pressure face.

24. The pump of claim 23, wherein said means for supplying pressure to said lubricating medium comprises:

a hydraulic ram assembly for selectively applying pressure to a reservoir containing a supply of said lubricating medium; and means for connecting said reservoir in fluid communication with said pressure chamber in said bearing assembly.

25. The pump of claim 20, further comprising a hopper for holding a supply of said concrete, said ports of said pumping cylinders being formed in a first wall of said hopper so as to be in communication with said supply of concrete.

26. The pump of claim 25, wherein said swing tube is positioned within said hopper, and said support structure to which said sleeve member is mounted comprises a second wall of said hopper through which said discharge end of said swing tube passes opposite said first wall of said hopper.

* * * * *